US006375521B2

(12) United States Patent
Tachi et al.

(10) Patent No.: US 6,375,521 B2
(45) Date of Patent: Apr. 23, 2002

(54) MALE TERMINAL FITTING AND A PRODUCTION METHOD THEREFORE

(75) Inventors: Hideshi Tachi; Kiyofumi Ichida, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/803,506

(22) Filed: Mar. 9, 2001

(30) Foreign Application Priority Data

Mar. 15, 2000 (JP) ..... 12-071922

(51) Int. Cl.[7] ..... H01R 9/24
(52) U.S. Cl. ..... 439/884; 439/877
(58) Field of Search ..... 439/849–852, 439/858, 861, 884, 877, 692, 601, 886

(56) References Cited

U.S. PATENT DOCUMENTS 5,591,054 A * 1/1997 Okada et al. ..... 439/884
5,649,842 A * 7/1997 Ohsumi ..... 439/858
5,664,974 A * 9/1997 Endo et al. ..... 439/884
5,681,192 A * 10/1997 Kobayashi et al. ..... 439/884
6,077,131 A * 6/2000 Fukuda et al. ..... 439/884

FOREIGN PATENT DOCUMENTS

JP 09-223532 8/1997
JP 11-224701 8/1999

* cited by examiner

*Primary Examiner*—Brian Sircus
*Assistant Examiner*—Son V. Nguyen
(74) *Attorney, Agent, or Firm*—Anthony J. Casella; Gerald E. Hespos

(57) ABSTRACT

A tab (10A) is comprised of a flat base (12), a substantially U-shaped turning portion (13), a flat overlapping portion (14) which is connected to a side end of the base (12) via the turning portion (13) and faces the base (12) substantially in parallel, and a raising portion (15) extending substantially at right angles from an end of the overlapping portion (14) and held in contact with the base (12). Thickness ta of the tab (10A) can be set at a desired value regardless of thickness tb of a terminal material by changing a curvature of the turning portion (13) and a projecting distance tc of the raising portion (15).

4 Claims, 4 Drawing Sheets

MALE TERMINAL FITTING AND A PRODUCTION METHOD THEREFORE

BACKGROUND OF THE INVENTION

1. Field of the Invention

The present invention relates to a male terminal fitting and to a production method for such a male terminal fitting.

2. Description of the Related Art

Male terminal fittings often are formed by stamping a plate-shaped metallic terminal material of a specified thickness and then bending the stamped material into a specified shape. The male terminal fitting of this type typically has the leading end of the terminal material folded back to form a thick tab, as shown, for example, in Japanese Unexamined Patent Publication No. 11-224701. A tab formed in this manner can be twice as thick as the terminal material.

The specified thickness of the tab of the male terminal fitting often is based on characteristics or design limitations of the female terminal fitting. The thickness of the terminal material for the male terminal fitting then is selected as half the specified thickness of the tab.

The male terminal fitting may also have a barrel that is configured to be crimped by an applicator into connection with a wire. Applicators have a range of material thickness that can be crimped. Attempts may be made to reduce production costs by reducing the number of kinds of applicators. However, the number of kinds of applicators that is required is determined by range of material thicknesses that is required, and the prior art terminal design required the range of material thicknesses to be dependent directly on the range of specified thicknesses of the tab. As a result, the prior art male terminal fitting design impeded the ability to reduce the number of types of applicators for crimping. Furthermore, a specification for a thick male terminal tab could complicate the crimping of the terminal fitting to the wire.

In view of the above situation, an object of the present invention is to form a tab having a desired thickness without being influenced by the thickness of a terminal material.

SUMMARY OF THE INVENTION

The invention is directed to a male terminal fitting made of a plate-shaped metallic terminal material and having a tab formed by folding back or bending the terminal material. The tab comprises a base and at least one substantially U-shaped turning portion. At least one overlapping portion is connected to the base via the turning portion and substantially faces the base. At least one raising portion extends from an end of the overlapping portion and is held substantially in contact with the base. Thus, at least one space is defined between the base, the turning portion, the overlapping portion and the raising portion. The thickness of the tab can be set at a desired value regardless of the thickness of the terminal material by changing a curvature of the turning portion and a projecting distance of the raising portion.

The overlapping portion and the base may be substantially flat and substantially parallel. Additionally, the raising portion may extend from the overlapping portion substantially at right angles and may be held in contact with the base.

Bending a narrow strip adjacent to an edge is difficult and has limits. Thus efforts to reduce the projecting distance of the raising portion are limited. However, a contact area of the base with the raising portion may be recessed to form a receiving portion that may be stepped from and substantially parallel to the remaining surface area of the base that faces into the space of the tab. The recessed receiving portion is formed in the contact area of the base with the raising portion. Therefore, the projecting distance of the raising portion can be acceptably large without increasing the overall thickness of the tab.

The contact area of the base with the raising portion may be formed into a receiving surface that is slanted with respect to the remaining area of the base. Additionally, a projecting end of the raising portion may be formed into a contact surface that is slanted and substantially parallel to the receiving surface or complementary to the corresponding receiving surface.

A variation of the projecting distance of the raising portion due to a tolerance can be taken up by bringing the contact surface into sliding contact with the receiving surface. Therefore, the thickness of the tab can be adjusted with high accuracy.

The base may comprise a mating raising portion that projects from the base and contacts the raising portion on the overlapping portion.

The invention also is directed to a method for producing a male terminal fitting. The method comprises providing a substantially plate-shaped metallic terminal material and forming a tab by folding back the terminal material. The folding step comprises bending the terminal material to form a base, at least one substantially U-shaped turning portion, at least one overlapping portion and at least one raising portion. The overlapping portion is connected to the base via the turning portion and substantially faces the base. The raising portion extends from an end of the overlapping portion and contacts the base.

The method may further comprise a step of recessing and/or slanting the base to form a receiving portion for the raising portion.

Additionally, the raising portion may be formed with a shape substantially complementary to the shape of the receiving portion.

These and other objects, features and advantages of the present invention will become apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
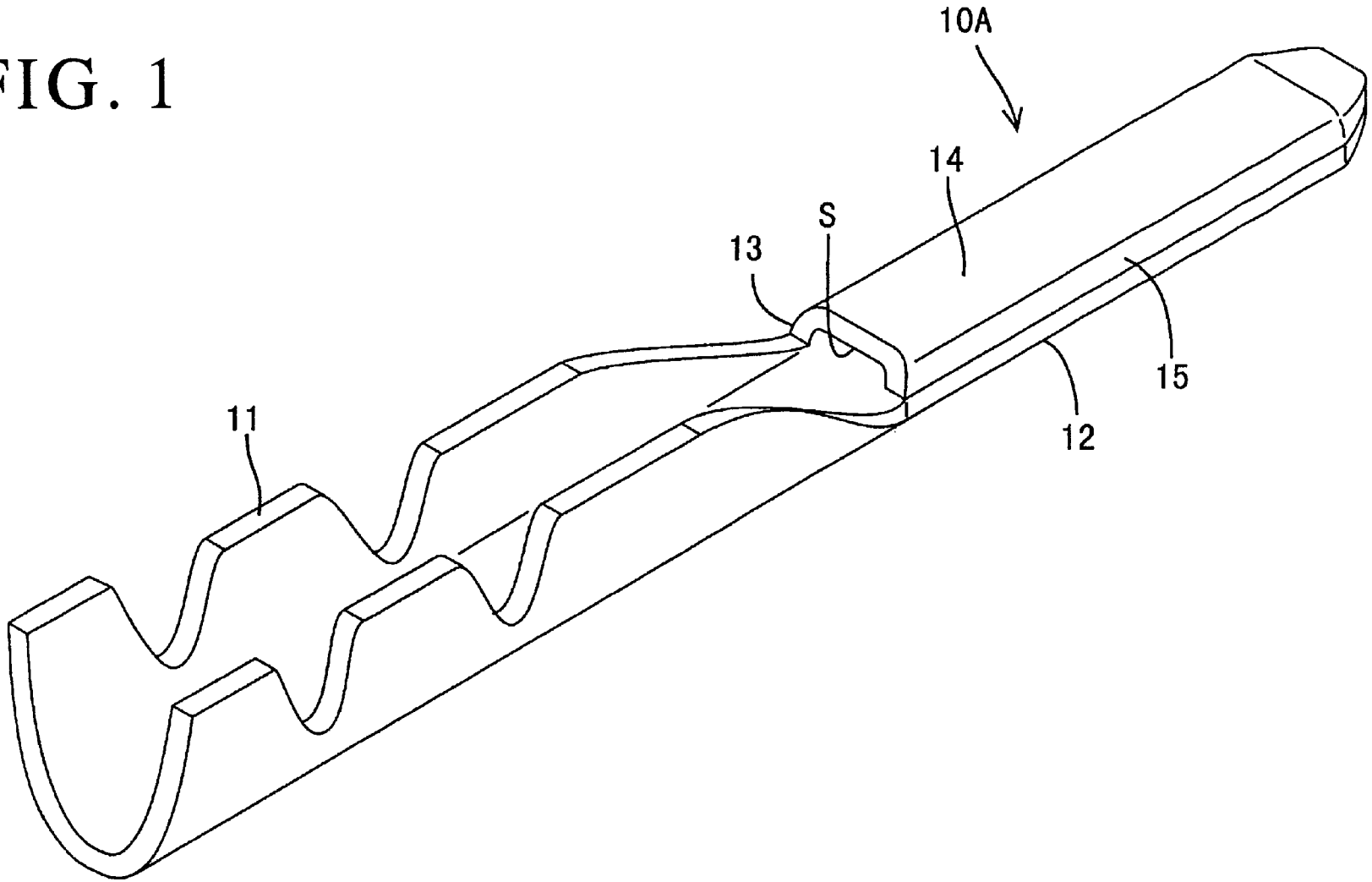
FIG. 1 is a perspective view of a first embodiment.
Figure 2:
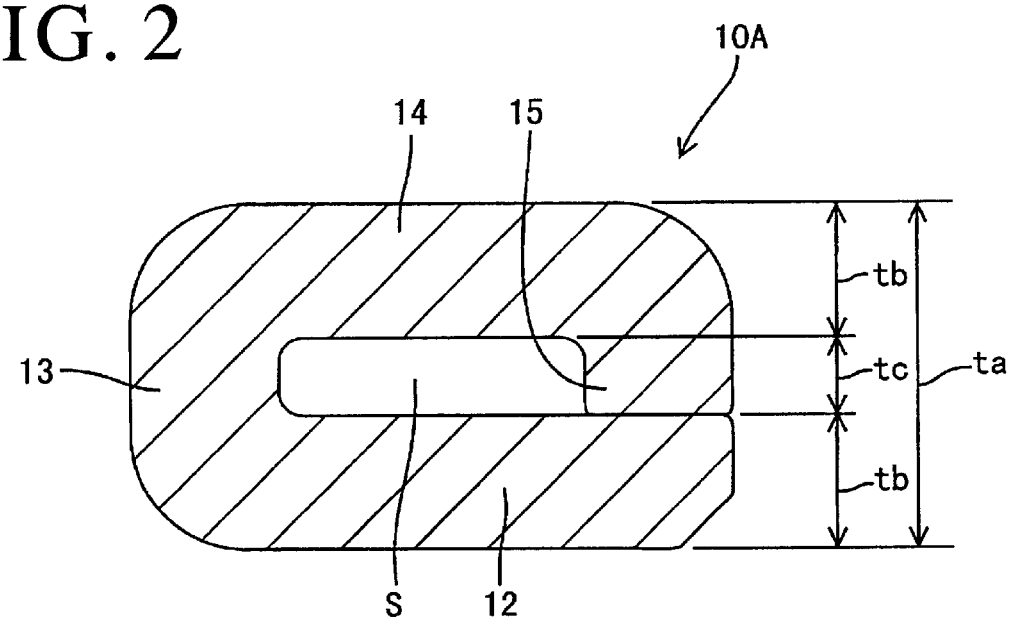
FIG. 2 is a lateral section of a tab of the first embodiment.

A male terminal fitting according to the first embodiment of the invention is formed by bending a conductive plate-shaped metallic terminal material that has been stamped by a press into a specified shape. As illustrated in FIGS. 1 and 2, an open barrel 11 is formed at the rear end of the male terminal fitting and a tab 10A is formed at the front end. The barrel 11 is configured to be crimped into connection with an unillustrated wire, and the tab 10A is configured for connection with an unillustrated female terminal fitting.

The tab 10A is formed by folding or bending back the terminal material along a fold that extends in forward and backward directions. Accordingly, the tab 10A is narrow or elongated in forward and backward directions. The thickness (dimension in a direction in which portions of the terminal material are placed one over the other by folding) of the tab 10A is specified by the state of the female terminal fitting. In this embodiment, the required thickness of the tab 10A is 0.65 mm, and a dimensional tolerance is ±0.02 to 0.025 mm. On the other hand, the thickness of the terminal material is 0.25 mm in this embodiment. The 0.25 mm thick terminal material can be folded to put the upper and lower portions of the terminal material together. As a result, the tab 10A would be thinner than the required 0.65 mm thickness by 0.15 mm. To solve this problem, the tab 10A is formed into the shape described below.

Specifically, as shown in FIG. 2, the tab 10A is comprised of a base 12 in the form of a substantially flat plate. A substantially U-shaped turning portion 13 extends from the base 12, and an overlapping portion 14 extends from the turning portion 13. The overlapping portion 14 is a substantially flat plate that is connected to the left side of the base 12 via the turning portion 13. Additionally, the overlapping portion 14 is substantially parallel to the base 12 and faces the upper surface of the base 12, with a space S defined between the base 12 and the overlapping portion 14. A raising portion 15 extends down at approximately a right angle from the right side, which is the side opposite the turning portion 13 with respect to the widthwise direction of the overlapping portion 14. The raising portion 15 is held in contact with the upper surface of the base 12.

The tab 10A is formed by first bending the substantially flat terminal material to form the raising portion 15. The overlapping portion 14 then is folded back with respect to the base 12. It is to be understood, that the base 12, the turning portion 13, the overlapping portion 14 and/or the raising portion 15 may be of a shape different from a flat shape, such as with embossments, recesses, grooves, projections, etc.

The base 12 and the overlapping portion 14 of the tab 10A each have a thickness tb of 0.25 mm, which is the thickness of the terminal material. Additionally, the raising portion 15 projects from the lower surface of the overlapping portion 14 a distance tc of 0.15 mm. Accordingly, the tab 10A has a total thickness ta, which is the sum of the thickness tb (0.25 mm) of the base 12, the thickness tb (0.25 mm) of the overlapping portion 14, and the projecting distance tc (0.15 mm) of the raising portion 15. Hence the thickness ta of the tab 10A is the required thickness of 0.65 mm.

The thickness ta of the tab 10A can be set at a desired value regardless of the thickness tb of the terminal material by changing the curvature of the turning portion 13 and the projecting distance tc of the raising portion 15.

Figure 3:
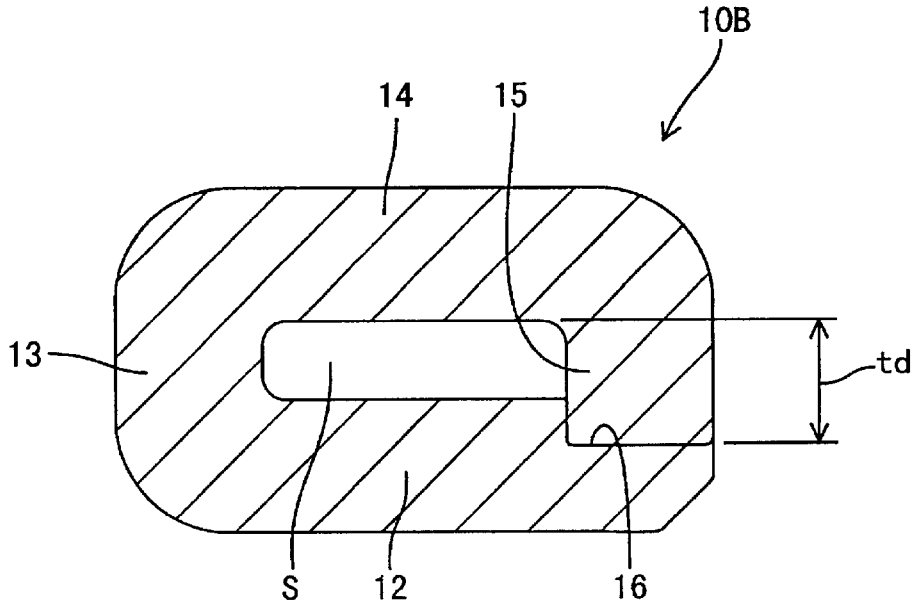
FIG. 3 is a lateral section of a tab of a second embodiment.

A tab 10B in accordance with a second embodiment of the invention is illustrated in FIG. 3. The tab 10B has a base 12, a turning portion 13, an overlapping portion 14 and a raising portion 15 substantially as in the first embodiment. However, the base 12 has a recessed receiving portion 16, which is stepped from and substantially parallel to the remaining area of the upper surface of the base 12. The receiving portion 16 is formed preferably by pressing a specified area by a press before bending is applied. After bending, the receiving portion 16 in contact with the raising portion 15.

There is a restriction in reducing the projecting distance of the raising portion 15 in view of bending processing. However, the recessed receiving portion 16 is formed in the contact area of the base 12 with the raising portion 15 in the second embodiment. Thus, a projecting distance td of the raising portion 15 from the overlapping portion 14 can be increased. Therefore, the raising portion 15 can be formed easily.

Figure 4:
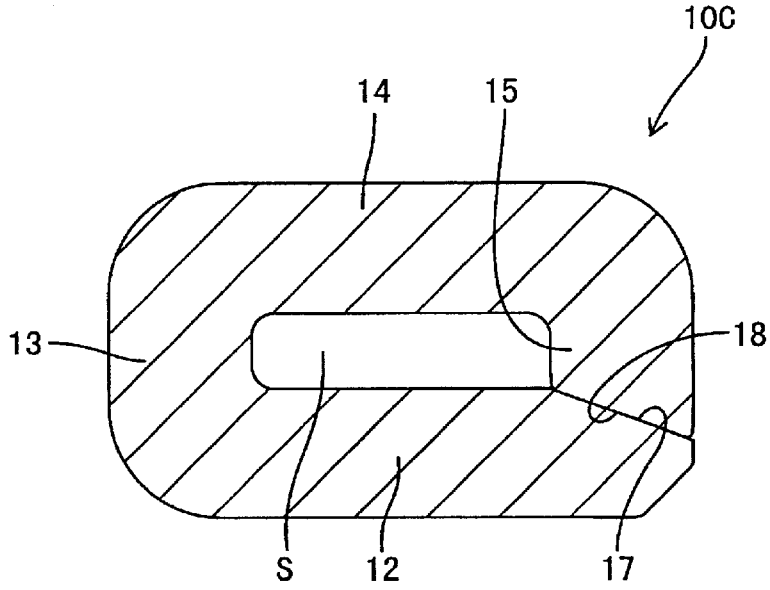
FIG. 4 is a lateral section of a tab of a third embodiment.

A tab 10C in accordance with a third embodiment of the invention is illustrated in FIG. 4. The tab 10C has a base 12, a turning portion 13, an overlapping portion 14 and a raising portion 15 substantially as in the first embodiment. However, the base 12 has a slanted receiving surface 17 that is aligned with the raising portion 15 and inclined with respect to the remaining area of the upper surface of the base 12. Additionally, a projecting end surface of the raised portion 15 is formed into a contact surface 18 which is inclined substantially parallel to the receiving surface 17 in the bent or final condition. The receiving surface 17 and the contact surface 18 are formed by pressing before bending is applied. After bending the contact surface 18 is in contact with the receiving surface 17.

According to the third embodiment, a variation of the projecting distance of the raising portion 15 due to a tolerance can be taken up by bringing the contact surface 18 into sliding contact with the receiving surface 17. Therefore, the thickness of the tab 10C can be adjusted with high accuracy.

Figure 5:
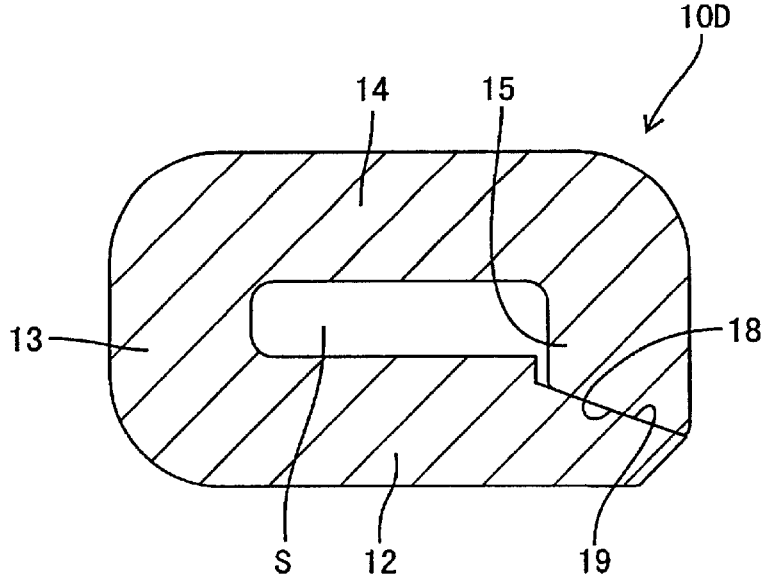
FIG. 5 is a lateral section of a tab of a fourth embodiment.

A tab 10D in accordance with a fourth embodiment of the invention is illustrated in FIG. 5. The tab 10D includes a base 12, a turning portion 13, an overlapping portion 14 and a raising portion 15 substantially as in the third embodiment. However, the tab 10D differs from the tab 10C of the third embodiment in that a receiving surface 19 is stepped down (lowered) from the upper surface of the base 12. Accordingly, the projecting distance of the raising portion 15 from the overlapping portion 14 can be increased, and the raising portion 15 can be formed easily formed.

Figure 6:
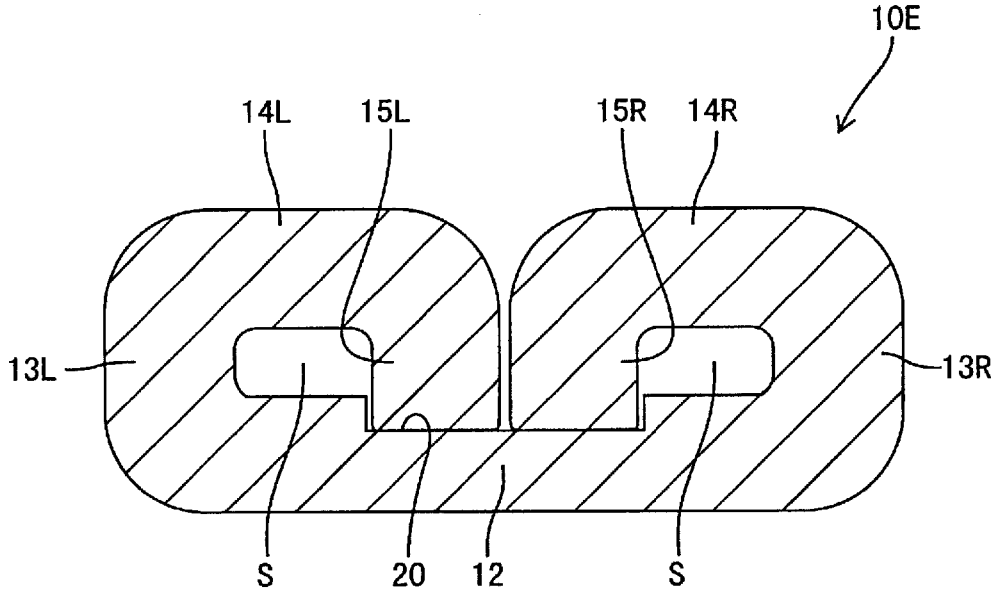
FIG. 6 is a lateral section of a tab of a fifth embodiment.

A tab 10E according to a fifth embodiment of the invention is illustrated in FIG. 6. The tab 10E has a base 12 similar to the preceding embodiments. However, the tab 10E has left and right overlapping portions 14L, 14R that are folded back from the opposite sides of the base 12 via turning portions 13L, 13R. Raising portions 15L, 15R are formed at the ends of the two overlapping portions 14L, 14R. A contact area of the base 12 with the raising portions 15L, 15R is in a widthwise middle portion of the upper surface of the base 12, and is characterized by a recessed receiving portion 20 that is stepped from and substantially parallel to the remaining area of the upper surface of the base 12. The raising portions 15L, 15R are in the widthwise center of the tab 10E. Thus, two separate spaces S are provided laterally between the base 12 and the overlapping portions 14L, 14R, thereby enhancing the rigidity of the tab 10E against squeezing forces that act in the thickness direction of the tab 10E. No description is given on the other action and effects of the tab 10E, since they are same as in the second embodiment.

The present invention is not limited to the above described and illustrated embodiments. For example, the following embodiments also are embraced by the technical scope of the present invention as defined in the claims. Beside the following embodiments, various changes can be made without departing the sprit of the present invention as defined in the claims.

Although one overlapping portion is folded back at only one side end of the base in the foregoing embodiments 1 to 4, two overlapping portions may be folded back at the opposite side ends of the base.

Although the raising portion projects only from the overlapping portion in the respective foregoing embodiments, two raising portions may project from both the overlapping portion and the base toward each other according to the present invention. In such a case, the projecting end surfaces of the both raising portions may substantially abut against each other or the raising portion projecting from the overlapping portion may be in contact with the base and the one projecting from the base may be in contact with the overlapping portion.

Although the slanted receiving surface is formed by thinning the base toward its side end edge opposite from the turning portion to form a wedge-shaped portion in the fourth and fifth embodiments, the inclination of the receiving surface may be reversed according to the present invention. In such a case, an area of the receiving surface may be larger than that of the contact surface.

Although the male terminal fitting connected with the wire by crimping is described in the foregoing embodiments, the present invention is also applicable to male terminal fittings connected with a wire by insulation displacement or by both crimping and insulation displacement.

What is claimed is:

1. A male terminal fitting, made of a plate-shaped metallic terminal material and having a tab formed by folding the terminal material, wherein the tab comprises a base, at least one substantially U-shaped turning portion extending from the base, at least one overlapping portion connected to the turning portion, the overlapping portion facing and being substantially parallel to the base, and at least one raising portion extending at substantially at a right angle from an end of the overlapping portion and held substantially in contact with the base, wherein a contact area of the base with the raising portion is recessed to form a receiving portion, which is stepped from and substantially parallel to remaining areas of the base.

2. A male terminal fitting according to claim 1, wherein at least one space is defined between the base, the turning portion, the overlapping portion and the raising portion.

3. A method for providing a male terminal fitting, comprising the following steps:

providing a substantially plate-shaped metallic terminal material and forming a tab from the plate-shaped metallic terminal material to define a base, recessing a portion of the base to define a receiving portion stepped from and substantially parallel to remaining areas of the base and bending the terminal material to form at least one substantially U-shaped turning portion extending form the base, at least one overlapping portion connected to the base via the turning portion and substantially facing the base and at least one raising portion extending substantially at right angle from an end of the overlapping portion and held substantially in contact with the receiving portion of the base.

4. A method according to claim 3, wherein the raising portion is formed with a shape substantially complementary to a shape of the receiving portion.

* * * * *